US009772582B2

(12) United States Patent
Fujii

(10) Patent No.: US 9,772,582 B2
(45) Date of Patent: Sep. 26, 2017

(54) DEVELOPER CONTAINER, CARTRIDGE, IMAGE FORMATION UNIT AND IMAGE FORMATION APPARATUS

(71) Applicant: Oki Data Corporation, Tokyo (JP)

(72) Inventor: Masashi Fujii, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/185,137

(22) Filed: Jun. 17, 2016

(65) Prior Publication Data

US 2017/0031271 A1 Feb. 2, 2017

(30) Foreign Application Priority Data

Jul. 28, 2015 (JP) ..... 2015-148646

(51) Int. Cl.
*G03G 15/08* (2006.01)

(52) U.S. Cl.
CPC ..... *G03G 15/0886* (2013.01)

(58) Field of Classification Search
CPC ..... G03G 15/0886; G03G 2215/067; G03G 2215/0692
USPC ..... 399/106, 262
See application file for complete search history.

(56) References Cited

U.S. PATENT DOCUMENTS

2008/0175629 A1* 7/2008 Eto ..... G03G 15/087 399/262

FOREIGN PATENT DOCUMENTS

JP 2014-170024 A 9/2014

* cited by examiner

*Primary Examiner* — Sandra Brase
(74) *Attorney, Agent, or Firm* — Metrolexis Law Group, PLLC

(57) ABSTRACT

A developer container is described that is capable of preventing the developer held inside the container from being squirted to the outside. A cartridge, an image formation unit and an image formation apparatus are described that are each provided with the developer container. The developer container has: a first member; a second member that is combined with the first member such that the first and second members form a developer storage room; and a third member that covers a boundary portion between the first member and the second member. An aspect of the invention is that it can prevent the developer from being squirted to the outside of the developer container.

20 Claims, 12 Drawing Sheets

DEVELOPER CONTAINER, CARTRIDGE, IMAGE FORMATION UNIT AND IMAGE FORMATION APPARATUS

CROSS REFERENCE TO RELATED APPLICATIONS

This application claims priority based on 35 USC 119 from prior Japanese Patent Application No. 2015-148646 filed on Jul. 28, 2015, entitled "DEVELOPER CONTAINER, CARTRIDGE, IMAGE FORMATION UNIT AND IMAGE FORMATION APPARATUS", the entire contents of which are incorporated herein by reference.

BACKGROUND OF THE INVENTION

1. Field of the Invention

The disclosure is related to a developer container storing developer, as well as a cartridge, an image formation unit, and an image formation apparatus that are each provided with the developer container.

2. Description of Related Art

Conventionally, an electrophotographic image formation apparatus has been proposed that is provided with a development device and a developer container that is removably mounted to the development device (see Japanese Patent Application Publication No. 2014-170024, for example).

SUMMARY OF THE INVENTION

Usually, such a developer container includes a combination of two or more members. Thus, when excessive vibration, impact, or pressure is applied to the developer container, there is a concern that the developer may be squirted from inside of the developer container.

Considering this problem, an object of the disclosure is to provide a developer container capable of preventing the developer from being squirted to the outside, as well as a cartridge, an image formation unit, and an image formation apparatus that are each provided with the developer container.

A first aspect of the invention is a developer container comprising: a first member; a second member that is combined with the first member such that the first and second members form a developer storage room; and a third member that covers a boundary portion between the first member and the second member.

A second aspect of the invention is a developer container comprising: a developer container body defining a developer storage room that can store developer, the developer container body including a recessed portion and an opening provided at the recessed portion and communicating with the developer storage room; a tubular shutter member that is attached in the recessed portion of the developer container body and is configured to close and open the opening of the developer container body; and an attachment member attached to an outer surface of the developer container body and covering a boundary portion between an inner circumferential surface of the recessed portion of the developer container body and an outer circumferential surface of the shutter member.

The aspects of the invention can prevent the developer from being squirted to the outside of the developer container.

DETAILED DESCRIPTION OF EMBODIMENTS

Figure 1:
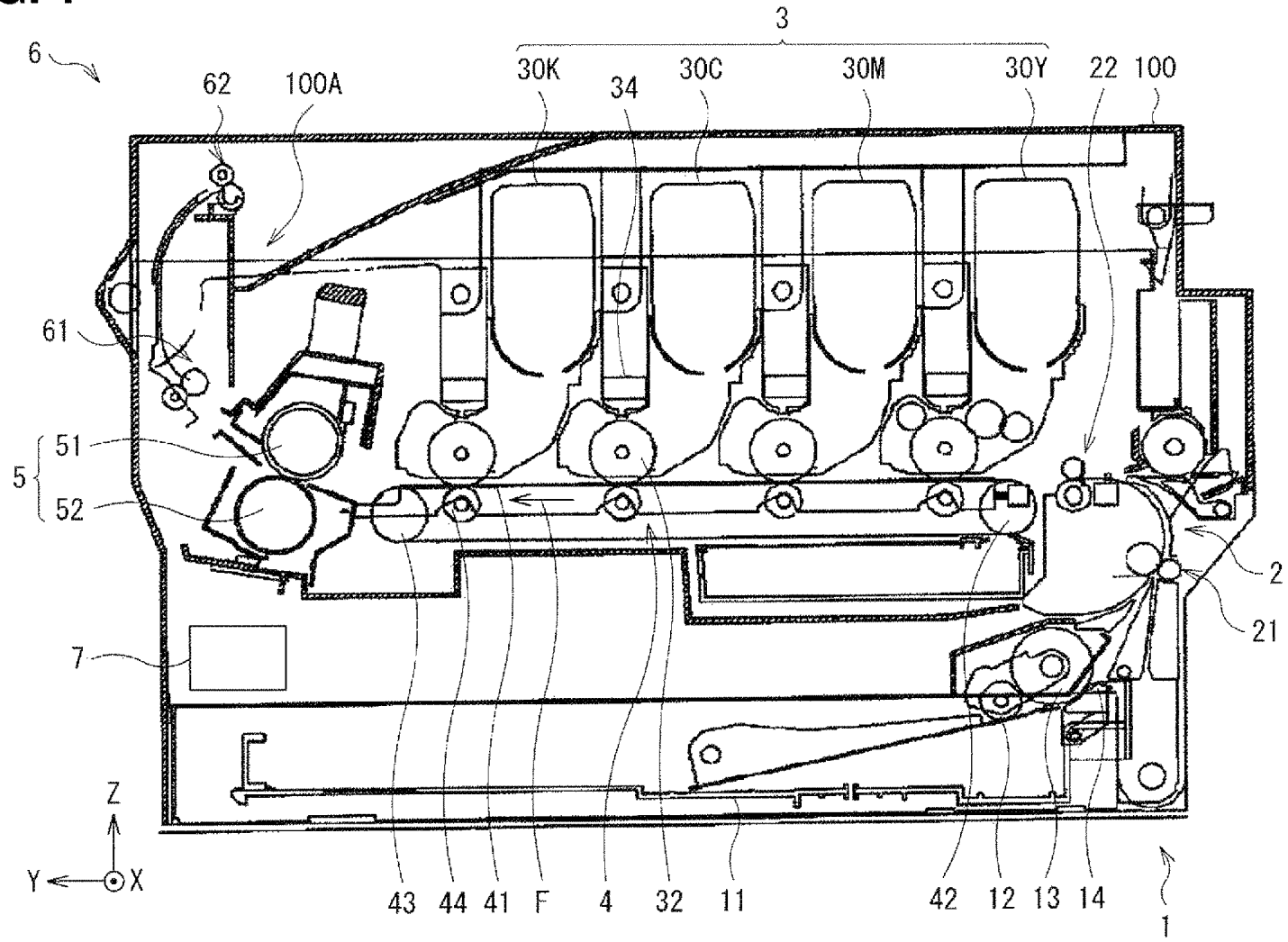
FIG. 1 is a schematic diagram illustrating an overall-configuration example of an image formation apparatus according to an embodiment of the invention.

Hereinbelow, embodiments of the invention are described in detail with reference to the drawings. Note that the following descriptions are specific examples of the invention, and the invention is not limited to the following embodiments. In addition, the invention is not limited to the arrangement, dimensions, dimensional ratios, and the like of constituent components illustrated in the drawings. The descriptions are given in the following order.

1. Embodiment (image formation apparatus provided with a developer container)
2. Modification

1. Embodiment

Configuration of the Image Formation Apparatus

FIG. 1 schematically illustrates an overall-configuration example of an image formation apparatus according to an embodiment of the invention. This image formation apparatus corresponds to a specific example of the "image formation apparatus" of the invention, and is an electrophotographic printer that forms an image (color image, for example) on medium PM as a printing target, such as paper or a film. The image formation apparatus includes medium feeding section 1, transport section 2, image formation section 3, transfer section 4, fuser section 5, discharge section 6, and controller 7 which are accommodated in housing 100. Controller 7 controls the operation of medium feeding section 1, transport section 2, image formation section 3, transfer section 4, fuser section 5, and discharge section 6. Note that a path for transporting medium PM is called a transport path in the specification. On the transport path, a direction toward medium feeding section 1 from a certain constituent component, or a position closer to medium feeding section 1 than the certain constituent component, is called upstream. On the other hand, on the transport path, a direction opposite to the direction toward medium feeding section 1 from a certain constituent component, or a position farther from medium feeding section 1 than the certain constituent component, is called downstream. In addition, on the transport path, a traveling direction of medium PM (that is, a direction from upstream to downstream) is called transport direction F. A direction (X axis direction in FIG. 1, for example) that is parallel to medium PM transported on the transport path and is orthogonal to transport direction F is called a width direction. A dimension in transport direction F is called length, and a dimension in the width direction is called width.

(Medium Feeding Section 1)

Medium feeding section 1 is configured to feed media PM one by one to transport section 2. Medium feeding section 1 includes cassette 11, pickup roller 12, feed roller 13, and retard roller 14, for example. Cassette 11 stores stacked sheet-shaped media PM. Cassette 11 is removably mounted on a lower portion of the image formation apparatus, for example. Pickup roller 12, feed roller 13, and retard roller 14 function to sequentially send out media PM stored in cassette 11 to the transport path leading to transport section 2. Pickup roller 12 and feed roller 13 are controlled by controller 7 and are configured to rotate in a direction of sending out medium PM toward transport section 2 in downstream. Pickup roller 12 is arranged in a position where pickup roller 12 can make contact to a top surface of the uppermost one of stacked media PM. Feed roller 13 is arranged downstream of pickup roller 12. Retard roller 14 is configured to prevent multiple media PM from being sent out together at one time. Retard roller 14 is arranged in a position to face feed roller 13 and is configured to rotate in a direction opposite to that of the rotation of feed roller 13.

(Transport Section 2)

Transport section 2 is configured to transport medium PM from medium feeding section 1 to transfer section 4 while regulating a skew of medium PM. Transport section 2 includes two pairs of registration rollers 21 and 22, for example.

(Image Formation Section 3)

Figure 2A:
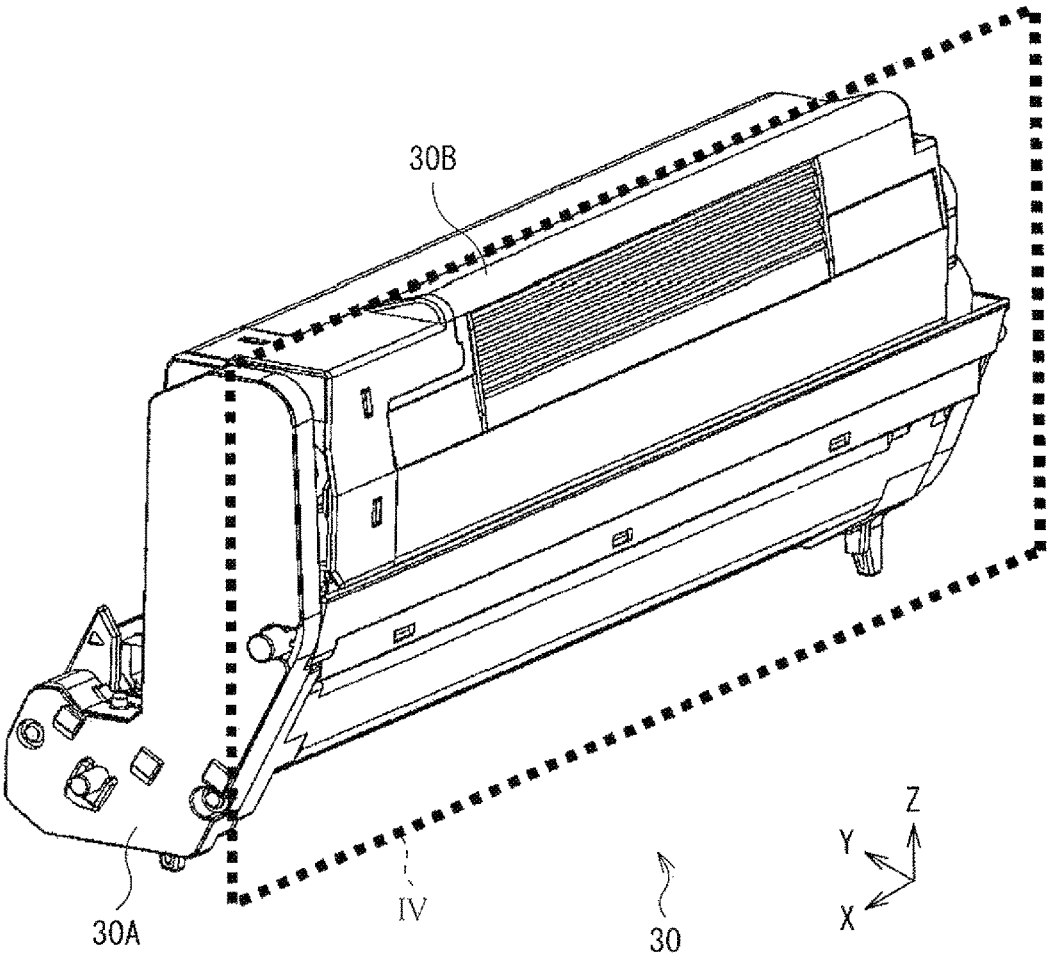
FIG. 2A is a perspective view illustrating an exterior of the image formation unit shown in FIG. 1.
Figure 2B:
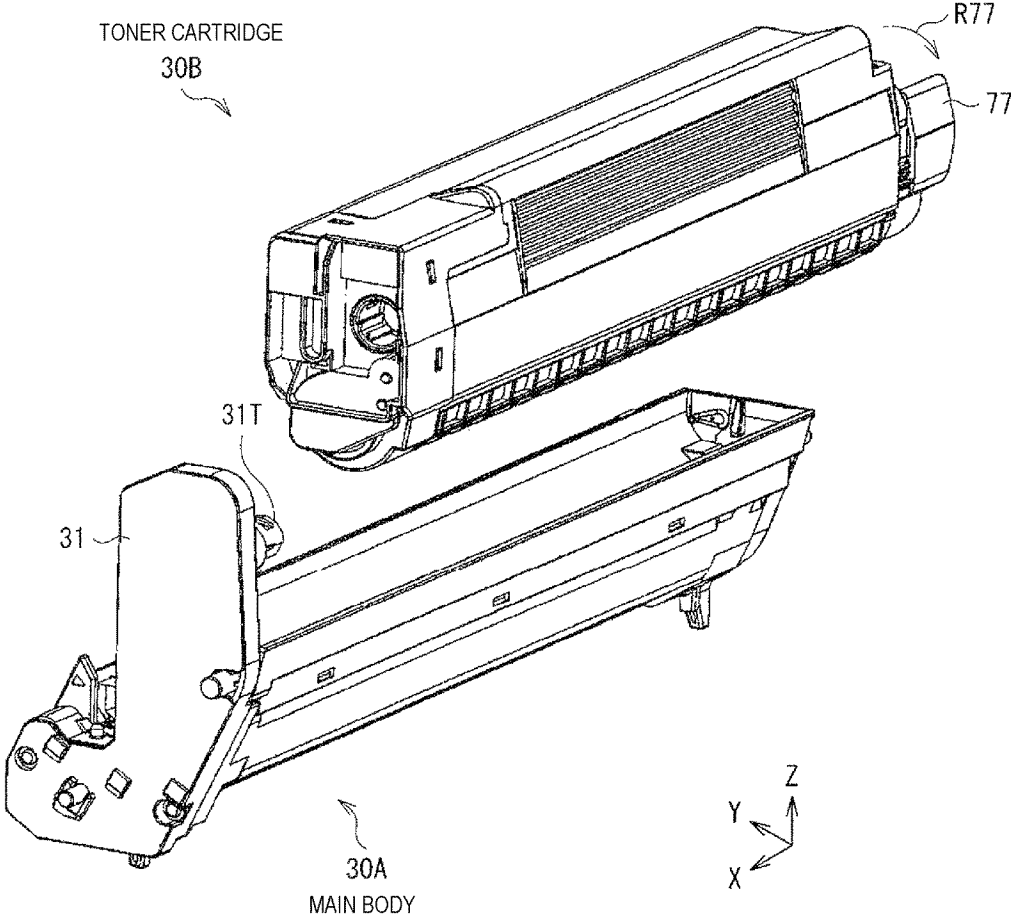
FIG. 2B is an exploded perspective view illustrating an exterior of the image formation unit shown in FIG. 1.

Image formation section 3 is configured to form toner image IMG on medium PM transported from transport section 2 (see later described FIG. 3). As illustrated in FIG. 1, image formation section 3 includes four image formation units 30Y, 30M, 30C, and 30K, for example. Image formation units 30Y, 30M, 30C, and 30K are configured to form toner images (picture images) IMG with each of the colors of yellow, magenta, cyan, and black, using toner T of the corresponding color. Image formation units 30 are arranged, for example, in the order of image formation unit 30Y, image formation unit 30M, image formation unit 30C, and image formation unit 30K in transport direction F. Note that when there is no need to discriminate, four image formation units 30Y, 30M, 30C, and 30K are generally termed as image formation unit 30 in the specification. As illustrated in FIGS. 2A and 2B, each image formation unit 30 includes main body 30A, and toner cartridge 30B provided above main body 30A, for example. Toner cartridge 30B is a body separated from main body 30A that is placed under toner cartridge 30B, and is configured to be removably mounted on main body 30A. Note that FIG. 2A is an enlarged perspective view of image formation unit 30 in a state where toner cartridge 30B is mounted on main body 30A. On the other hand, FIG. 2B is an exploded perspective view of image formation unit 30 in a state where toner cartridge 30B is separated from main body 30A.

Figure 3:
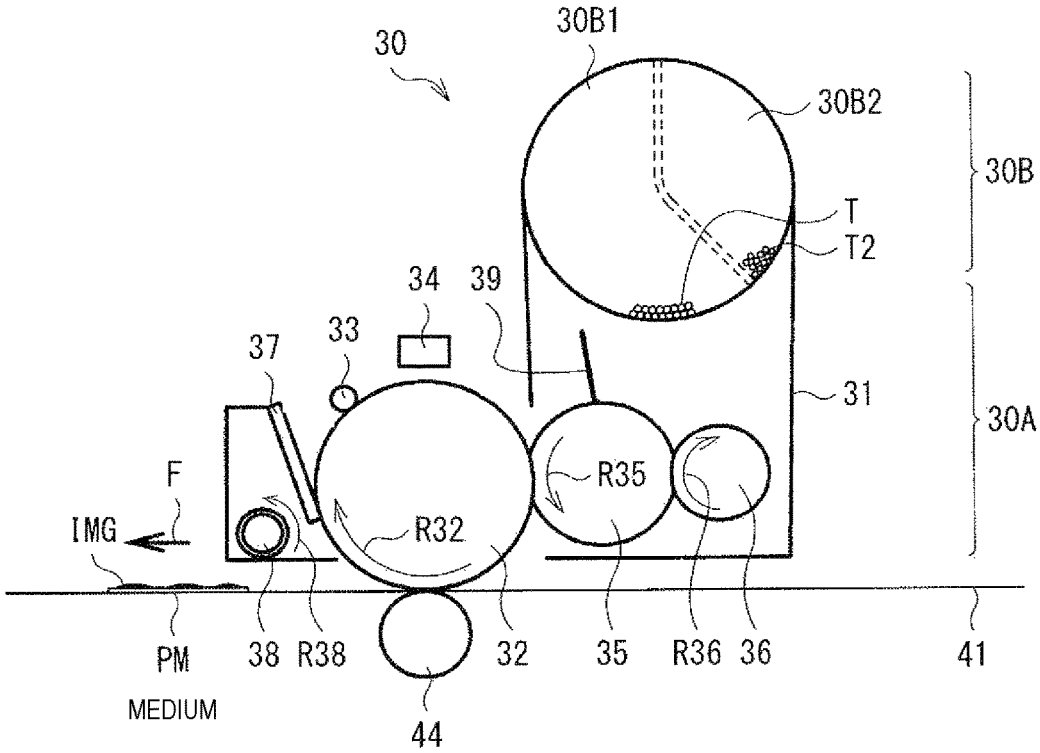
FIG. 3 is a schematic diagram illustrating an internal configuration of a main body of the image formation unit shown in FIG. 1.

FIG. 3 illustrates a schematic configuration of main body 30A and toner cartridge 30B. Here, FIG. 3 also illustrates constituent components of a part of the later described transfer section 4. Main body 30A includes cover 31, photoreceptor drum 32 surrounded with cover 31, charge roller 33, developer roller 35, supply roller 36, cleaning blade 37, waste toner transport spiral 38, doctor blade 39, and light emitting diode (LED) head 34 that is provided to be capable of exposing photoreceptor drum 32 to light from the outside of cover 31. In addition, toner T is stored inside of toner cartridge 30B. Note that the details of image formation unit 30 are described later.

(Transfer Section 4)

Transfer section 4 is also called a transfer belt unit. Transfer section 4 includes transfer belt 41, drive roller 42 that drives transfer belt 41, idle roller 43 as a driven roller, and transfer rollers 44 arranged to face respective photoreceptor drums 32 across transfer belt 41. Each of drive roller 42 and idle roller 43 is a substantially-cylindrical member that is rotatable on its rotational axis which extends in the width direction. Transfer section 4 is a mechanism configured to sequentially transfer toner images IMG formed by respective image formation units 30Y, 30M, 30C, and 30K to a surface of medium PM transported from transport section 2 while transporting medium PM along transport direction F.

Transfer belt 41 is, for example, an endless elastic belt made of a resin material such as a polyimide resin. Transfer belt 41 is stretchingly provided (stretchingly extended) around drive roller 42 and idle roller 43. Under the control of controller 7, drive roller 42 is rotationally driven in the direction of transporting medium PM in transfer direction F, and to circularly rotate transfer belt 41. Drive roller 42 is arranged upstream of image formation units 30Y, 30M, 30C, and 30K. With urging force from an urging member, idle roller 43 is configured to adjust the tension applied on transfer belt 41. Idle roller 43 is arranged in the downstream side from image formation units 30Y, 30M, 30C, and 30K, and is configured to rotate in the same direction with that of the rotation of driving roller 42.

Transfer roller 44 is a member configured to electrostatically transfer toner images IMG formed by corresponding image formation units 30Y, 30M, 30C, and 30K onto medium PM, while transporting medium PM in transfer direction F by rotating in a direction opposite to that of the rotation of photoreceptor drum 32. Transfer roller 44 is made of foamed semi-conductive elastic rubber material, for example.

(Fuser Section 5)

Fuser section 5 is a member configured to apply heat and pressure to the toner images IMG transferred on medium PM that passed through transfer section 4, thereby fusing the toner images IMG on medium PM. Fuser section 5 includes upper roller 51 and lower roller 52, for example.

Each of upper roller 51 and lower roller 52 includes therein a heat source that is a heater, such as a halogen lamp, and functions as a heat roller to apply heat to the toner images IMG on medium PM. Upper roller 51 is controlled by controller 7 and is configured to rotate in the direction of transporting medium PM in transport direction F. The heat source inside each of upper roller 51 and lower roller 52 is supplied with a bias voltage controlled by controller 7 and controls the surface temperature of upper roller 51 or lower roller 52. Lower roller 52 is arranged to face upper roller 51 so that a portion of lower roller 52 is in pressure contact with upper roller 51, and functions as a pressure roller to apply pressure to the toner image IMG on medium PM. Lower roller 52 preferably includes a surface layer made of an elastic material.

(Discharge Section 6)

Discharge section 6 is configured to deliver to the outside medium PM on which the toner image IMG is fused by fuser section 5. Discharge section 6 includes transport rollers 61 and 62, for example. Transport rollers 61 and 62 are configured to deliver medium PM to the outside via the transport path, and to stack medium PM in stacker 100A outside of the image formation apparatus. Transport rollers 61 and 62 are controlled by controller 7 and are configured to rotate in the direction of transporting medium PM in transport direction F.

[Configuration of Image Formation Unit 30]

Next, details of a configuration of image formation unit 30 are described. Each image formation unit 30 includes main body 30A or an image formation unit main body and toner cartridge 30B or a developer container attached to the main body 30A.

(Configuration of Main Body 30A)

Photoreceptor drum 32 serving as an image carrier is a cylindrical member made of a photoreceptor (an organic photoreceptor, for example) and is capable of carrying an electrostatic latent image on a surface (top layer). Specifically, photoreceptor drum 32 includes a conductive support, and a photoconductive layer that covers an outer periphery (surface) of the conductive support. The conductive support includes a metal pipe made of aluminum, for example. The photoconductive layer has a structure including a charge generation layer and a charge conveyance layer sequentially laminated. Photoconductive drum 32 is controlled by a controller 7 and is configured to rotate with a predetermined circumferential speed in the direction (direction of arrow R32) of transporting medium PM in transport direction F.

Charge roller 33 is a member (charge member) arranged in contact with the surface (peripheral surface) of photoreceptor drum 32 and is configured to charge the surface (top layer) of photoreceptor drum 32. Charge roller 33 includes a metal shaft, and a semi-conductive rubber layer (semi-conductive epichlorohydrin rubber layer, for example) that covers an outer periphery (surface) of the metal shaft, for example. Charge roller 33 is controlled by controller 7 and is configured to, for example, rotate in the same direction as that of the rotation of photoreceptor drum 32.

LED head 34 is an exposure device configured to form the electrostatic latent image on the surface (top layer) of photoreceptor drum 32 by exposing the surface of photoreceptor drum 32. For one photoreceptor drum 32 to light, LED head 34 includes multiple LED light-emitting parts lined in the width direction. Each of the LED light-emitting parts includes a light source such as a light-emitting diode that emits irradiation light, and a lens array that forms an image of the irradiation light on the surface of photoreceptor drum 32, for example.

Developer roller 35, or a development member, is arranged in contact with the surface (peripheral surface) of photoreceptor drum 32, and is configured to carry, on the surface thereof, toner T for supplying and developing the electrostatic latent image on the photoreceptor drum 32. Developer roller 35 includes a metal shaft, and a semi-conductive polyurethane rubber layer that covers an outer periphery (surface) of the metal shaft, for example. Developer roller 35 is controlled by controller 7 and is configured to rotate with a predetermined circumferential speed in the direction (direction of arrow R35) opposite to that of the rotation of photoreceptor drum 32.

Supply roller 36, or a supply member, is arranged in contact with the surface (peripheral surface) of developer roller 35, and is configured to supply toner T to developer roller 35. Supply roller 36 includes a metal shaft, and a foamed silicone rubber layer that covers an outer periphery (surface) of the metal shaft, for example. Supply roller 36 is controlled by controller 7 and is configured to rotate in the direction (direction of arrow R36) opposite to that of the rotation of developer roller 35.

Cleaning blade 37 is configured to scrape toner T remaining on the surface of photoreceptor drum 32. Cleaning blade 37 is made of flexible rubber material or plastic material, for example.

Waste toner transport spiral 38 is a developer transport member that includes, for example, a spiral blade provided to stand around a shaft thereof, and is configured to, for example, rotate in a direction of arrow R38 under the control of controller 7. Waste toner transport spiral 38 functions to rotate to transport toner T (called waste toner T2 hereinbelow) scraped by cleaning blade 37 in a +X direction.

Doctor blade 39 is a developer regulation member configured to regulate an amount of toner T adhered on the surface of developer roller 35.

Figure 4:
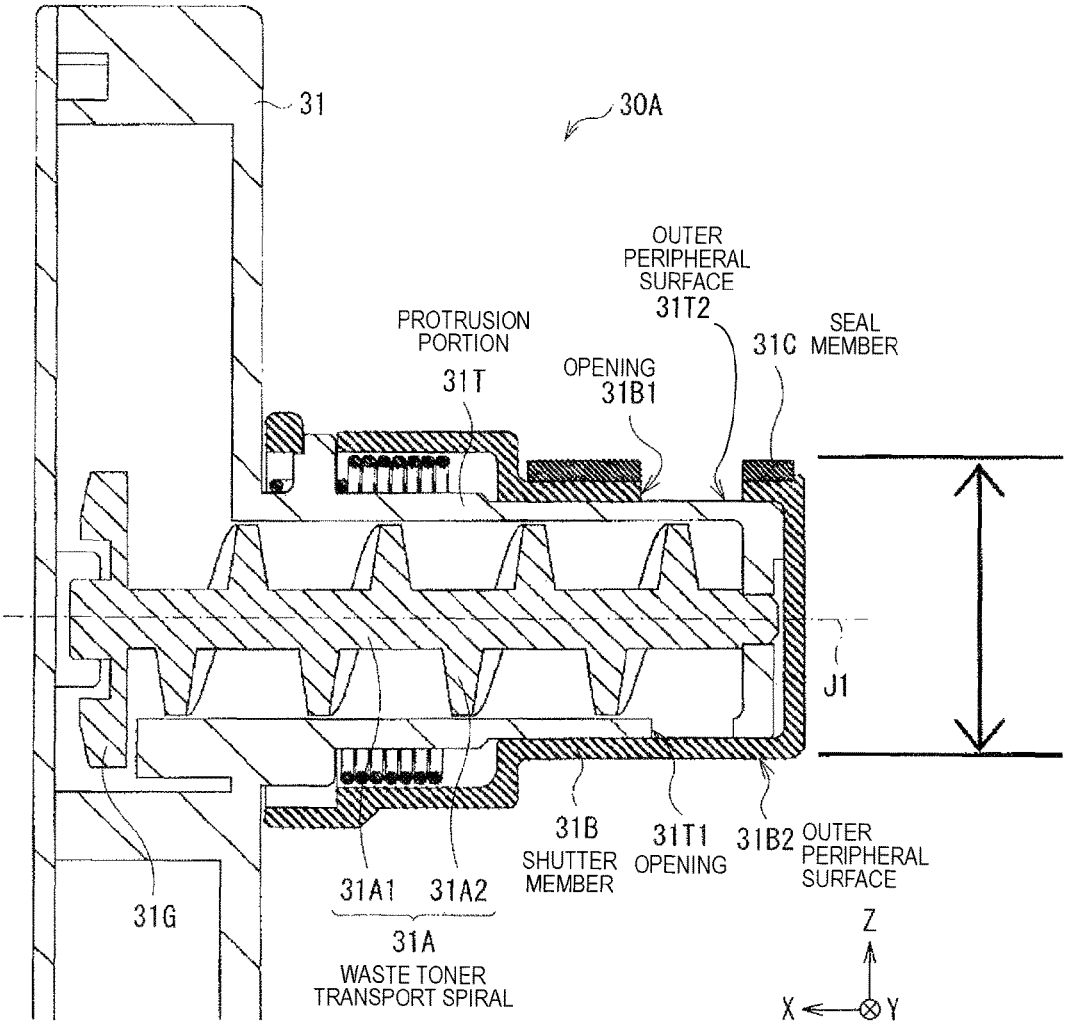
FIG. 4 is a cross-sectional view of the main body shown in FIG. 2A.

FIG. 4 is a cross-sectional view of main body 30A in cross-section IV along the XZ plane illustrated in FIG. 2A. Here, FIG. 4 illustrates main body 30A that is in a state (separated state) where toner cartridge 30B is separated from main body 30A, or a state (separatable state) where toner cartridge 30B is separatable from main body 30A. As illustrated in FIG. 4, cover 31 includes protrusion portion 31T protruding in the −X direction toward toner cartridge 30B. Protrusion portion 31T has for example, a substantially-cylindrical hollow structure including outer peripheral surface 31T2 and axis J1 as a central axis extending in the X axis direction, and is provided with opening 31T1 in a side surface thereof. Inside of protrusion portion 31T, waste toner transport spiral 31A extending in the X axis direction is housed to be rotatable about axis J1. Waste toner transport spiral 31A is configured to transport waste toner T2, which is transported by waste toner transport spiral 38, in the −X direction in protrusion portion 31T, and discharges waste toner T2 through opening 31T1. As illustrated in FIG. 4, like waste toner transport spiral 38, waste toner transport spiral 31A includes a spiral blade 31A2 provided to stand around shaft 31A1 that rotates about axis J1. One end of waste toner transport spiral 31A is provided with gear portion 31G. In addition, waste toner transport spiral 31A is configured to be rotated by power transmitted to gear portion 31G. Around protrusion portion 31T, shutter member 31B is provided and at least a part thereof is in contact with outer peripheral surface 31T2 of protrusion portion 31T. A part of the side surface of shutter member 31B is provided with opening 31B1. With a rotation of shutter member 31B, opening 31B1 moves along outer peripheral surface 31T2 while rotating about axis J1, and thereby relative positions of openings 31B1 and 31T1 are changed. In the separatable state in FIG. 4, a position of opening 31T1 of main body 30A and a position of opening 31B1 of shutter member 31B are totally different. In other words, opening 31T1 is completely covered with shutter member 31B. Thus, waste toner T2 transported by waste toner transport spiral 31A and accumulated inside of protrusion portion 31T does not leak to the outside. Here, a part of outer peripheral surface 31B2 of shutter member 31B in a vicinity of opening 31B1 is provided with seal member 31C made of elastic material such as a sponge, for example.

(Configuration of Toner Cartridge 30B)

Figure 5:
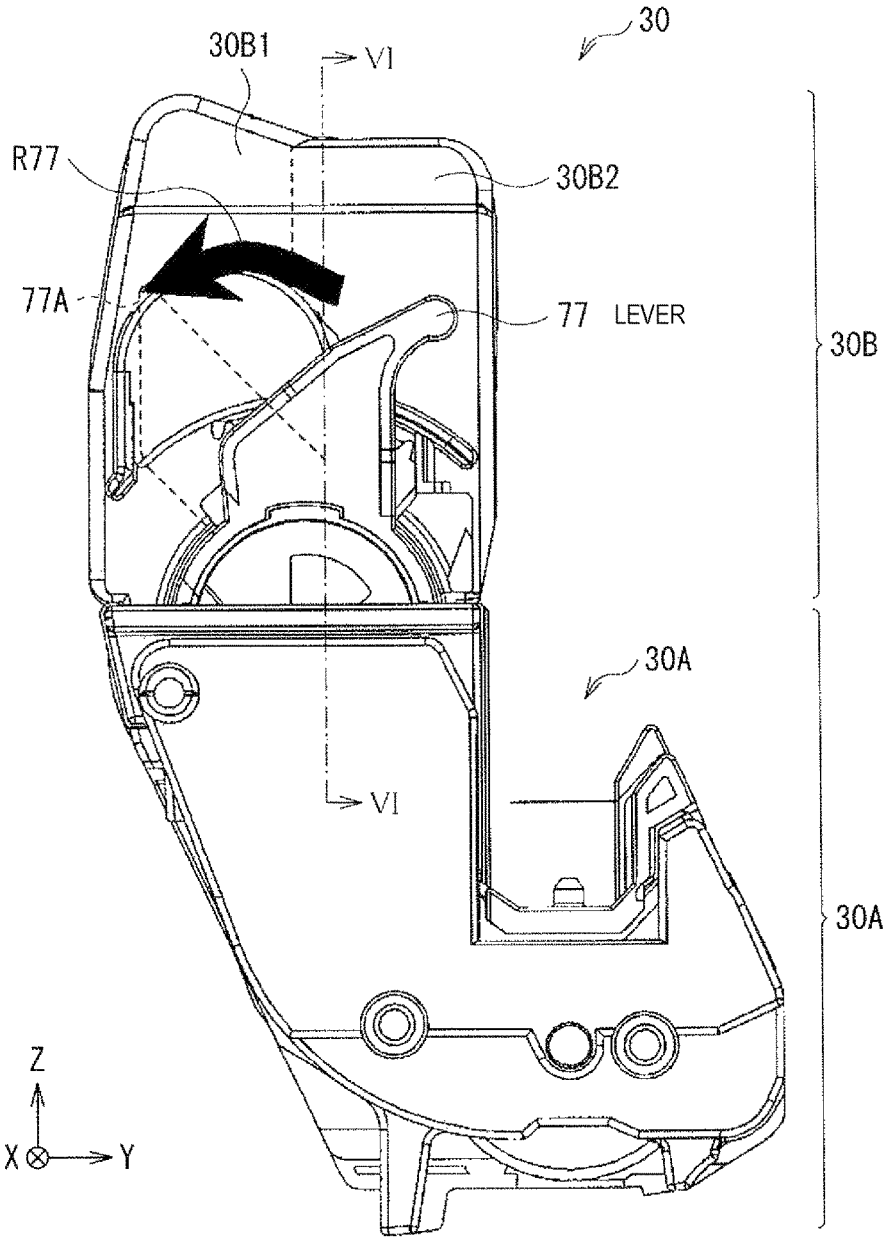
FIG. 5 is a side view of the image formation unit shown in FIG. 2A.
Figure 6:
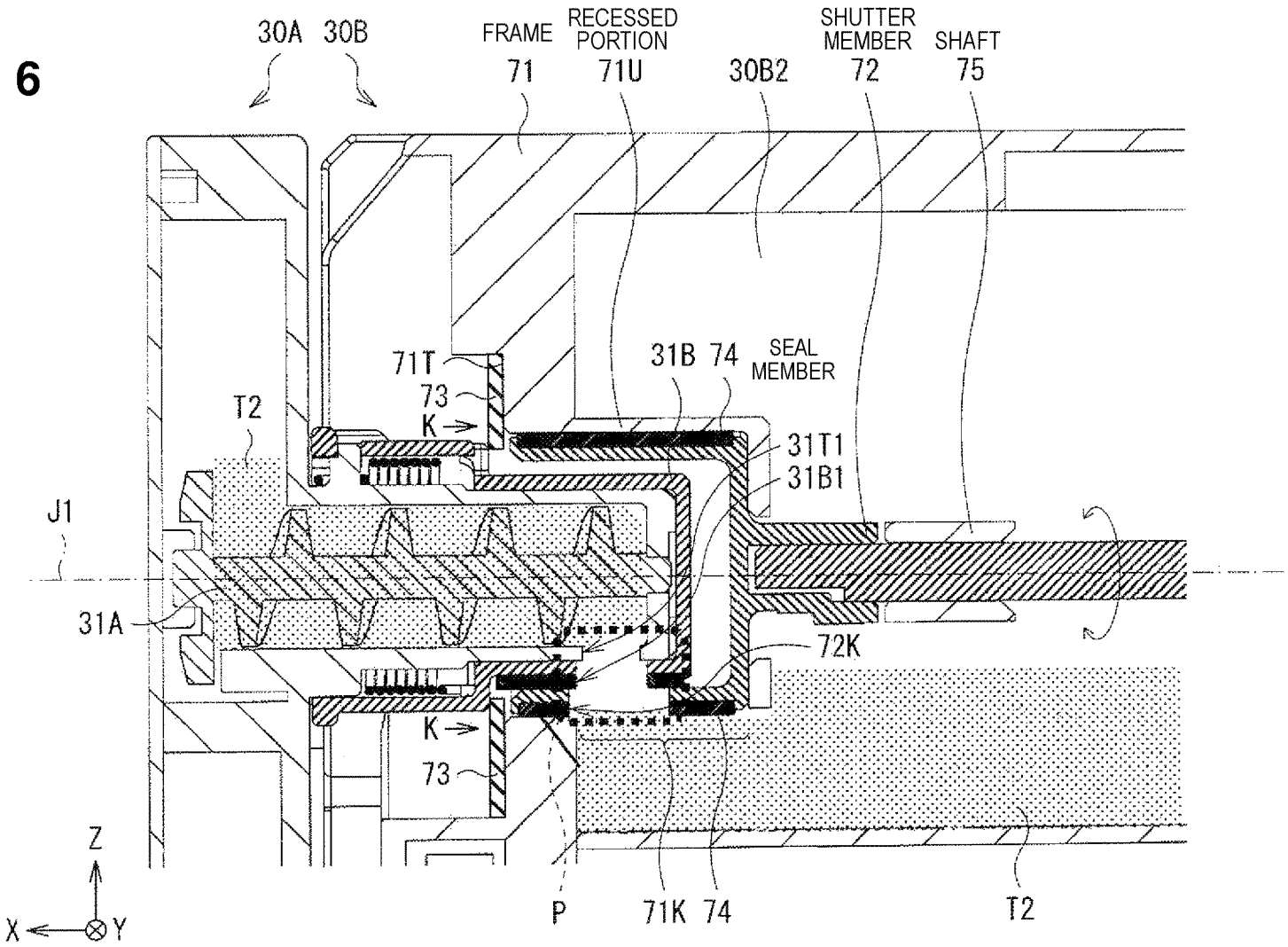
FIG. 6 is a cross-sectional view of a part of the image formation unit shown in FIG. 2A.

Next, details of the configuration of toner cartridge 30B are described with reference to FIGS. 5 to 8. FIG. 5 is a side view of image formation unit 30 illustrated in FIG. 2A from an opposite side in the +X direction. FIG. 6 is a cross-sectional view of image formation unit 30 in cross-section VI along the XZ plane illustrated in FIG. 5. Toner cartridge 30B, serving as a developer container, includes: (a) frame 71, serving as a developer container body with a hollow structure, (b) shutter member 72 combined with frame 71 to form toner storage chamber 30B1 and waste toner storage chamber 30B2, and (c) film 73. Toner storage chamber 30B1 stores the above-mentioned color toner T before use. Toner storage chamber 30B1 of image formation unit 30Y stores the yellow toner. Likewise, toner storage chamber 30B1 of image formation unit 30M stores the magenta toner, toner storage chamber 30B1 of image formation unit 30C stores the cyan toner, and toner storage chamber 30B1 of image formation unit 30K stores the black toner.

Figure 7:
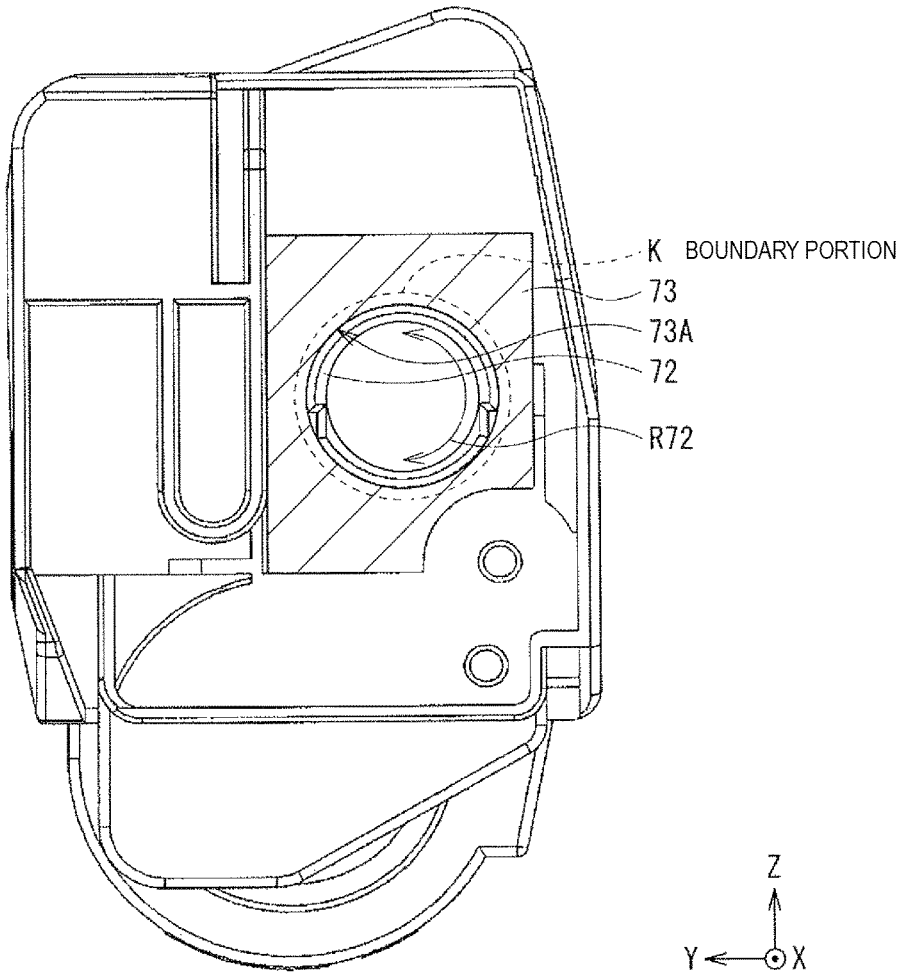
FIG. 7 is a side view of a toner cartridge shown in FIG. 2A.

Frame 71 is provided with recessed portion 71U at a position that faces protrusion portion 31T of main body 30A and shutter member 31B. Protrusion portion 31T and shutter member 31B are inserted in recessed portion 71U. FIG. 7 is aside view of toner cartridge 30B in the +X direction. Film 73 is, for example, made of an elastic body such as a resin film and includes opening 73A around the center thereof. Film 73 is fixed to end surface 71T of frame 71 so as to surround recessed port ion 71U, and is provided to cover boundary portion K between frame 71 and shutter member 72. Specifically, film 73 entirely covers boundary portion K as seen from the outside of toner cartridge 30B. Incidentally, film 73 may be integrally formed with frame 71. Frame 71 holds shutter member 72 such that shutter member 72 can rotate in the YZ plane. Specifically, shutter member 72 is fixed to one end of shaft 75 extending in the X axis direction in waste toner storage chamber 30B2 of frame 71. The other end (the end portion on the opposite side from shutter member 72) of shaft 75 is connected to lever 77 (see FIGS. 2B and 5). Therefore, when lever 77 is rotated, shutter member 72 can be rotated via shaft 75 in the direction of arrow R72 about axis J1. Boundary portion K is provided with seal member 74 made of an elastic material such as a sponge, for example. Seal member 74 is, for example, fixed on an outer peripheral surface of shutter member 72, and is configured to rotate together with shutter member 72 while being in contact with an inner peripheral surface of recessed portion 71U. In the embodiment, shutter member 72 has a tubular shape having a bottom part. Specifically, shutter member 72 includes a substantially-cylindrical tubular part, the bottom part covering one end of the tubular part, and an engagement part extending from the bottom part toward the one end of the shaft 75 and configured to be fixed to the one end of shaft 75.

Here, frame 71 is a specific example of a "first member" or a "developer container body" of the invention, and shutter member 72 is a specific example of a "second member" or "shutter member" of the invention. Toner storage chamber 30B1 and waste toner storage chamber 30B2 correspond to a specific example of a "storage" or "a developer storage room" of the invention. In addition, film 73 is a specific example corresponding to a "third member" or an "attachment member" of the invention. Accordingly, frame 71, shutter member 72, and film 73 are specific examples corresponding to a "developer container" of the invention.

Frame 71 includes opening 71K that is openable and closable with the rotation of shutter member 72. In other words, the shutter member 72 closes opening 71K of Frame 71 at a first rotational position of shutter member 72 and opens opening 71K of frame 71 at a second rotational position of shutter member 72. The position of opening 71K basically coincides with the position of opening 31T1 (see FIG. 6) in a state where protrusion portion 31T of main body 30A is inserted in recessed portion 71U of toner cartridge 30B. In addition, shutter member 72 includes opening 72K communicating with opening 31B1 of shutter member 31B. Shutter member 72 is configured to rotate about axis J1 in conjunction with shutter member 31B while basically keeping a positional relation with openings 31B1 and 72K. Therefore, when shutter members 72 and 31B integrally rotate to make the positions of openings 31B1 and 72K coincide with the positions of openings 31T1 and 71K as illustrated in FIG. 6, path P is formed through which an internal space of main body 30A and an internal space of toner cartridge 30B communicate with each other. Thus, in this state, waste toner T2 can move from main body 30A to toner cartridge 30B. Note that FIGS. 5 and 6 illustrate a state where toner cartridge 30B is mounted on main body 30A.

Figure 8:
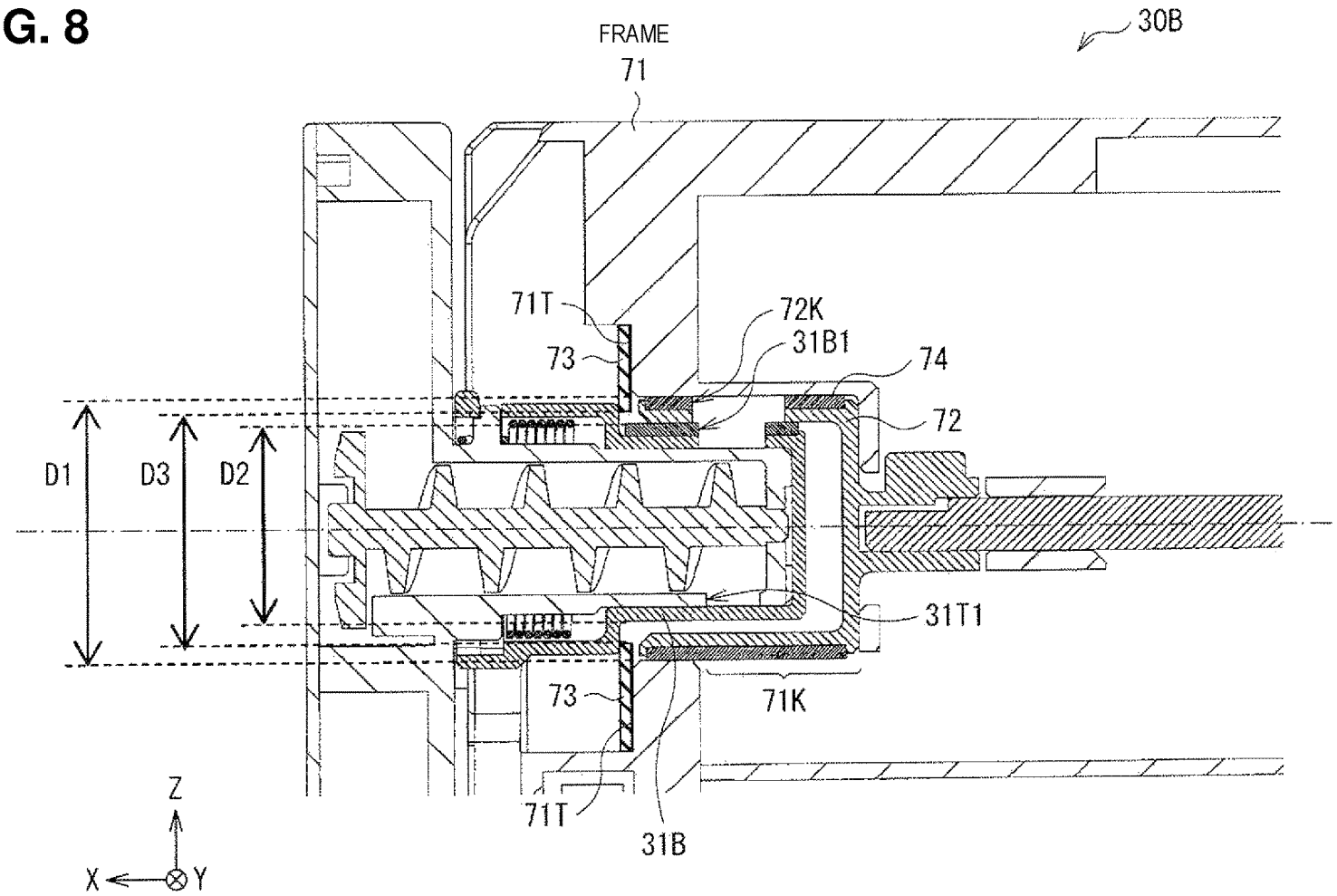
FIG. 8 is a cross-sectional view of the part of the image formation unit shown in FIG. 2A in a separatable state where the toner cartridge is separatable from the main body.

On the other hand, FIG. 7 illustrates a state (separated state) where toner cartridge 30B is removed from main body 30A, and FIG. 8 illustrates the vicinity of a coupling portion of main body 30A and toner cartridge 30B in a state (separatable state) where toner cartridge 30B is removable from main body 30A. In such a separated state, or separatable state, the positions of openings 31B1 and 72K do not coincide with the positions of openings 31T1 and 71K, and thereby path P is shut off. Therefore, in the separated or separatable state, waste toner T2 is not squirted from main body 30A and toner cartridge 30B to the outside, basically.

Boundary portion K has a cylindrical shape which makes a circuit along the rotation direction of shutter member 72 and extends in a rotation axis direction (X axis direction that is an extending direction of axis J1) of shutter member 72, for example. That is, boundary portion K is in a tubular shape surrounding axis J1, or in a cylindrical shape encircling about axis J1. As illustrated in FIG. 8, opening 73A of film 73 has inner diameter D3 that is smaller than inner diameter D1 in cylindrical boundary portion K. Such inner diameter D3 is intended to arrange film 73 on an extension of boundary portion K in the −X direction. In other words, a projected image of film 73 in the +X direction can be located over boundary portion K. In addition, inner diameter D3 of opening 73A is preferably equal to or larger than inner diameter D2 of shutter member 72 in boundary portion K. This is because film 73 can be prevented from interfering with shutter member 31B in the process of mounting or removing toner cartridge 30B onto or from main body 30A. In other word, protrusion portion 31T, shutter member 31B, and waste toner transport spiral 31A are inserted through opening 73A of film 73 to recessed portion 71U.

[Operation and Effect]

(A. Basic Operation)

In the image formation apparatus, the toner image IMG is transferred on medium PM in the following manner.

When print image data and a print command are inputted to controller 7 of the activated image formation apparatus from an external device such as a PC, controller 7 starts the printing of the print image data according to the print command.

For example, as illustrated in FIG. 1, each of media PM stored in cassette 11 is picked up from the uppermost one of the stacked media PM by pickup roller 12. Then, medium PM is send out to transport section 2 in downstream while being subjected to skew correction by feed roller 13 and retard roller 14. Then, medium PM is transported to image formation section 3 by two pairs of registration rollers 21 and 22. In the image formation section 3, toner image IMG is transferred on medium PM in the following manner.

In the image formation section 3, according to the print command of controller 7, toner image IMG of each of the colors is formed by the following electrophotographic process. Specifically, controller 7 puts toner T stored in toner storage chamber 30B1 of toner cartridge 30B into the inside of cover 31 of main body 30A, and rotates photoreceptor drum 32 in the direction of arrow R32 with a constant speed. Accompanying with this operation, charge roller 33, developer roller 35, and supply roller 36 also start the rotations in predetermined directions.

On the other hand, controller 7 applies a predetermined voltage to charge roller 33 of each color and uniformly charges the surface of photoreceptor drum 32 of each color. Then, controller 7 activates LED head 34, irradiates photoreceptor drum 32 of each color with light corresponding to a color component of a print image that is based on an image signal, and forms the electrostatic latent image on the surface of photoreceptor drum 32 of the color.

Toner T is supplied to developer roller 35 via supply roller 36, and is carried on the surface of developer roller 35. Developer roller 35 forms toner image IMG by adhering toner T on the electrostatic latent image formed on photoreceptor drum 32. In addition, an electric field is generated between photoreceptor drum 32 and transfer roller 44 by applying a predetermined voltage to transfer roller 44 in transfer section 4. In this state, when medium. PM travels between photoreceptor drum 32 and transfer roller 44, toner image IMG formed on photoreceptor drum 32 is transferred on medium PM.

Then, toner images IMG on medium PM are fused on medium PM by fuser section 5 with heat and pressure being applied thereto. Finally, in discharge section 6, medium PM on which toner image IMG is fused is delivered to stacker 100A outside of the image formation apparatus.

(B. Description of the Mounting and Removing Operations of Toner Cartridge 30B)

Here, the mounting and removing operations of toner cartridge 30B in image formation unit 30 of the embodiment are described with reference to FIG. 5 and the like. FIG. 5 illustrates a state where image formation unit 30 is ready for use with toner cartridge 30B mounted on main body 30A. From this ready state, lever 77 is rotated in the direction of arrow R77 and is moved to position 77A, indicated with a dashed line. With this operation, shaft 75 and shutter member 72 rotate about axis J1 and path P connecting openings 31T1 and 71K is shut off by shutter members 72 and 31B as illustrated in FIG. 8. Therefore, toner cartridge 30B becomes separatable (FIG. 8) from main body 30A. Note that when mounting toner cartridge 30B on main body 30A, lever 77 is rotated in the direction opposite to the direction of arrow R77, and is moved to an original position from position 77A, indicated with the dashed line. In this way, path P illustrated in FIG. 6 is formed, which allows waste toner T2 to move to toner cartridge 30B from main body 30A. Note that film 73 is not an obstacle to the mounting and removing operations of toner cartridge 30B in the process of the mounting and removing.

(C. Operation and Effect of the Image Formation Apparatus)

Figure 9:
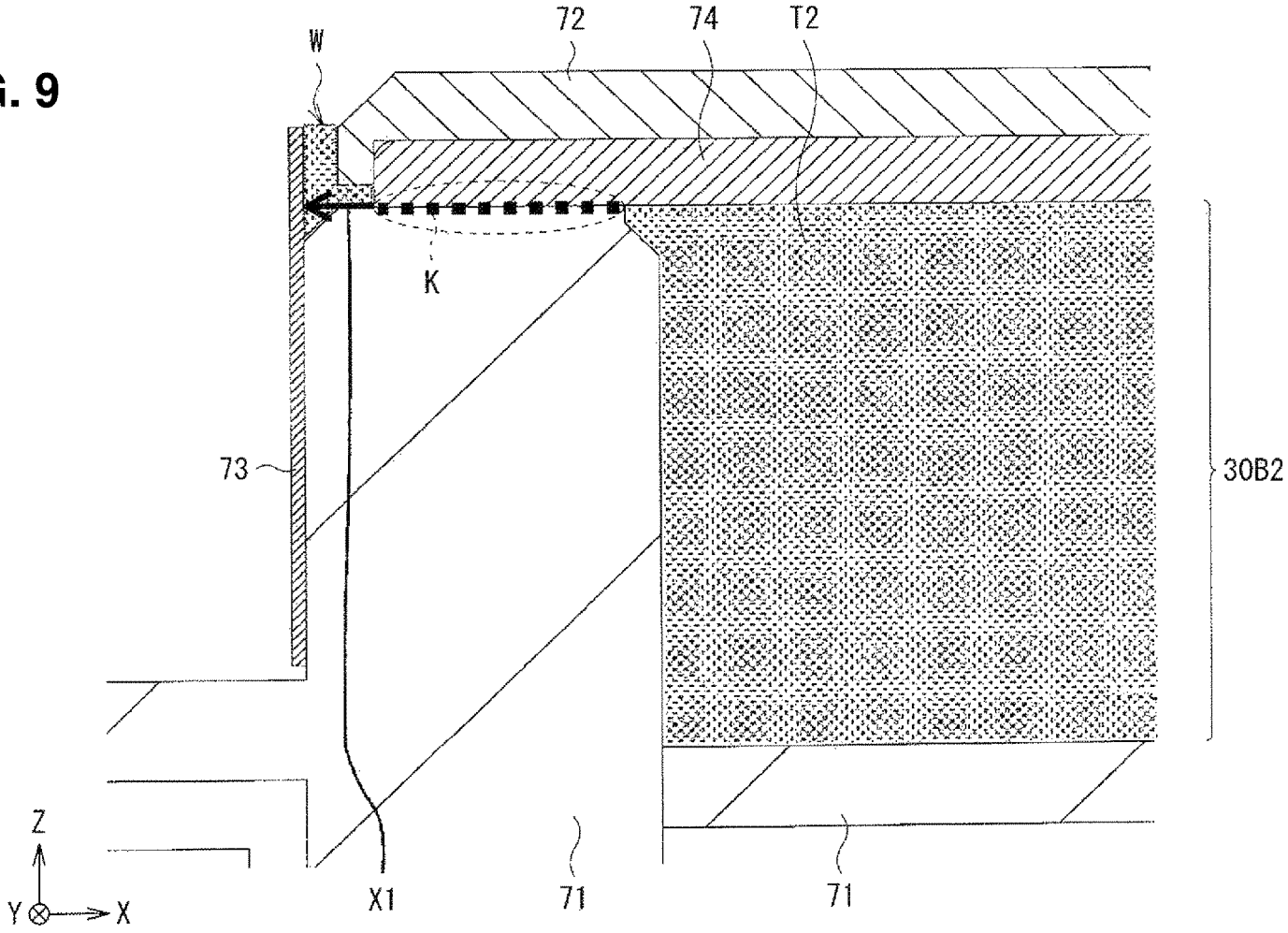
FIG. 9 is an enlarged cross-sectional view for describing the workings of the toner cartridge shown in FIG. 2A.

In the embodiment, film 73 covering boundary portion K between frame 71 and shutter member 72 is provided in toner cartridge 30B as described above. Therefore, even in the case where toner cartridge 30B removed from main body 30A suddenly receives a large impact applied by an unexpected accident, such as a fall, it is possible to prevent waste toner T2 stored in waste toner storage chamber 30B2 from being squirted to the outside. In a normal state, waste toner storage chamber 30B2 is in a sealed state by seal member 74 applying constant pressure to frame 71 in boundary portion K. Thus, waste toner T2 does not leak from waste toner storage chamber 30B2 to the outside. However, in the case where pressure in waste toner storage chamber 30B2 is rapidly increased due to a fall or any other accident of toner cartridge 30B, the increased pressure may exceed the seal pressure of seal member 74 and waste toner T2 may be slightly squirted and run down boundary portion K in the direction of arrow X1, for example, as illustrated in FIG. 9. By increasing the seal pressure of seal member 74, it is possible to prevent an excessive impact from causing the squirt of waste toner T; however, in that case, an increase in friction between seal member 74 and recessed portion 71U may affect the rotation of shutter member 72. Hence, in order to prepare for such unexpected accidents, the embodiment provides film 73 on the extension of boundary portion K in the direction of arrow X1. In this way, even in the case where waste toner T2 leaks from boundary portion K, leaked waste toner T2 can be kept within region W that is surrounded by film 73, shutter member 72, seal member 74, and frame 71. Accordingly, even in the case where excessive vibration, impact, or pressure is applied to toner cartridge 30B, toner cartridge 30B can sufficiently prevent waste toner T from being squirted to a large area.

2. Modification

The invention has been described with the embodiment above; however, the invention is not limited to the embodiment and various modifications are possible. For example, in the embodiment, the image formation apparatus forming the color image is described; however, the invention is not limited to the embodiment, but may be applied to an image formation apparatus forming a monochrome image by transferring only a black toner image, for example. In addition, in the embodiment, the image formation apparatus with the secondary transfer method is described; however, the invention may be applied to an image formation apparatus with the primary transfer method.

Moreover, a series of processing described in the embodiment may be performed by either of hardware (circuit) and software (program). When the processing is performed by software, the software includes a group of programs causing a computer to execute the functions. The programs may be used by being embedded in the computer in advance or being installed from a network or a storage medium to the computer.

Further, in the embodiment, LED head having a light-emitting diode as a light source is used as the exposure device; however, an exposure device having a light source such as laser elements may be used, for example.

Furthermore, in the embodiment, the image formation apparatus including a print function is described as a non-limiting specific example of an "image formation apparatus" according to the invention. Specifically, the invention can be also applied to, for example, an image formation apparatus that functions as a multifunction printer including a scan function and facsimile function in addition to the print function.

In the embodiment and the like, the configuration in which main body 30A and toner cartridge 30B are detachably combined with each other is exemplarily illustrated; however, the technique is not limited to this configuration. Main body 30A and toner cartridge 30B may have an integrated structure by being fit or screwed to each other, for example.

Figure 10:
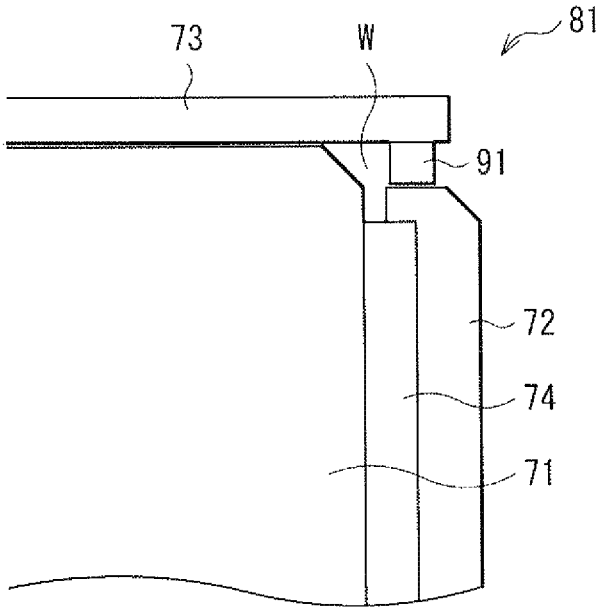
FIG. 10 is an enlarged cross-sectional view illustrating a part of a toner cartridge of a first modification.

In addition, like toner cartridge 81 as a first modification illustrated in FIG. 10, region W may be sealed by seal member 91 provided in a clearance between shutter member 72 and film 73. Even in a case where waste toner T2 leaks from boundary portion K, this configuration may be able to prevent leaked waste toner T2 from moving to the outside of region W.

Figure 11:
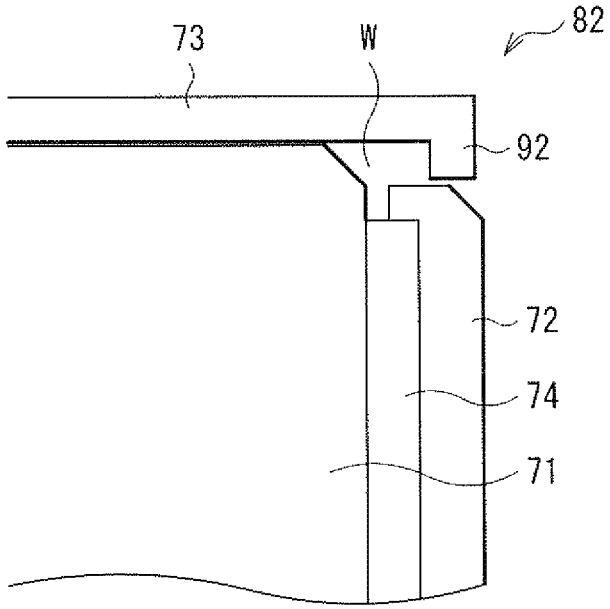
FIG. 11 is an enlarged cross-sectional view illustrating a part of a toner cartridge of a second modification.

Moreover, like toner cartridge 82 as a second modification illustrated in FIG. 11, a tip end of film 73 may be bended to provide bend portion 92. Even in a case where waste toner T2 leaks from boundary portion K, this configuration may be able to prevent leaked waste toner T2 from moving to the outside of region W.

Figure 12:
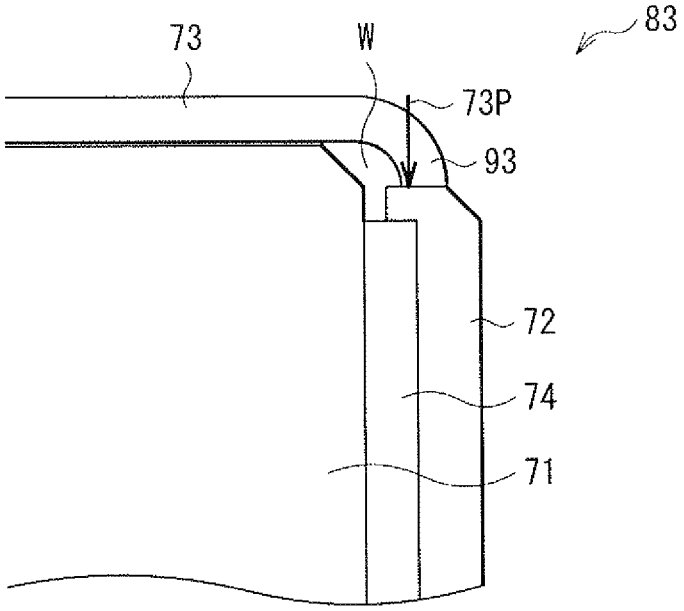
FIG. 12 is an enlarged cross-sectional view illustrating a part of a toner cartridge of a third modification.

Furthermore, like toner cartridge 83 as a third modification illustrated in FIG. 12, curve portion 93 may be provided on the tip end of film 73 such that curve portion 93 in contact with shutter member 72 can apply urging force 73P to shutter member 72 by means of the elasticity of film 73. Even in a case where waste toner T2 leaks from boundary portion K, this configuration may be able to prevent leaked waste toner T2 from moving to the outside of region W.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. A developer container comprising:

a first member defining a developer storage room therein and including a recessed portion;

a second member that is attached in the recessed portion of the first member; and a third member that is attached to an outer surface of the first member at an area surrounding the recessed portion of the first member, wherein the third member includes a hole with an inner diameter that is smaller than an inner diameter of the recessed portion such that a projection image of the hole of the third member in a direction orthogonal to a radial direction of the hole is located inside of the recessed portion.

2. The developer container according to claim 1, wherein the first member holds the second member such that the second member is rotatable about a rotation axis.

3. The developer container according to claim 2, wherein the first member includes one or more openings that are able to be opened and closed with a rotation of the second member about the rotation axis, wherein the one or more openings communicate with the developer storage room.

4. The developer container according to claim 2, wherein a boundary portion between the first member and the second member is in a cylindrical shape encircling about the rotation axis of the second member, and the inner diameter of the hole of the third member is smaller than an inner diameter of the boundary portion in the cylindrical shape, the inner diameter of the boundary portion being orthogonal to the rotation axis.

5. The developer container according to claim 4, wherein the inner diameter of the hole of the third member is equal to or larger than an inner diameter of the second member in the boundary portion.

6. The developer container according to claim 1, wherein the second member is provided with an elastic member in contact with the first member in a boundary portion between the first member and the second member.

7. The developer container according to claim 1, wherein the third member is made of an elastic body.

8. The developer container according to claim 7, wherein the third member is in contact with the second member and applies an urging force to the second member.

9. The developer container according to claim 1, wherein the third member is fixed to the first member.

10. The developer container according to claim 9, wherein an elastic member is further provided between the second member and the third member.

11. The developer container according to claim 1, wherein the first member and the third member are formed integrally.

12. The developer container according to claim 1, wherein the third member includes a bend portion or a curve portion.

13. A cartridge comprising the developer container according to claim 1, wherein the cartridge is attachable to an image formation unit main body.

14. An image formation unit comprising:

the developer container according to claim 1; and an image formation unit main body attached to the developer container and configured to form a developer image by using the developer in the developer container.

15. An image formation apparatus comprising:

an image formation unit including the developer container according to claim 1, wherein the image formation unit is configured to form a developer image by using the developer in the developer container.

16. A developer container comprising:

a developer container body defining a developer storage room that can store developer, the developer container body including a recessed portion and an opening provided at the recessed portion and communicating with the developer storage room;

a tubular shutter member that is attached in the recessed portion of the developer container body and is configured to close and open the opening of the developer container body; and an attachment member attached to an outer surface of the developer container body and covering a boundary portion between an inner circumferential surface of the recessed portion of the developer container body and an outer circumferential surface of the shutter member.

17. The developer container according to claim 16, further comprising a tubular elastic member between the inner circumferential surface of the recessed portion of the developer container body and the outer circumferential surface of the shutter member.

18. The developer container according to claim 17, wherein the boundary portion includes a boundary between an inner periphery of the recessed portion of the developer container body and the elastic member and a boundary between the elastic member and an outer periphery of the shutter member, wherein the attachment member covers both of the boundaries.

19. The developer container according to claim 16, wherein the attachment member includes a hole at a position corresponding to the recessed portion of the developer container body, and a diameter of the hole of the attachment member is equal to or larger than an inner diameter of the recessed portion of the shutter member.

20. A developer container comprising:

a first member defining a developer storage room therein and including a recessed portion;

a second member that is attached in the recessed portion of the first member; and a third member that is attached to an outer surface of the first member and covers an opening of the recessed portion, wherein the third member includes a hole with a diameter that is smaller than an inner diameter of the recessed portion such that the hole of the third member is located inside of a periphery of the opening of the recessed portion.

* * * * *